US007926809B2

(12) United States Patent
Tseng

(10) Patent No.: US 7,926,809 B2
(45) **Date of Patent: *Apr. 19, 2011**

(54) AUTOMATIC PLAYING CARD DISPENSING SYSTEM

(76) Inventor: Tzu-Hsiang Tseng, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/458,919

(22) Filed: Jul. 28, 2009

(65) Prior Publication Data

US 2011/0024981 A1 Feb. 3, 2011

(51) Int. Cl.
*A63F 3/00* (2006.01)

(52) U.S. Cl. ..... 273/256

(58) Field of Classification Search ..... None
See application file for complete search history.

(56) References Cited

U.S. PATENT DOCUMENTS 4,257,291 A * 3/1981 Buchmann ..... 83/76.1
4,677,565 A * 6/1987 Ogaki et al. ..... 700/234
5,282,628 A * 2/1994 Komori et al. ..... 473/136
5,408,417 A * 4/1995 Wilder ..... 705/5
5,584,483 A * 12/1996 Sines et al. ..... 273/149 R
5,722,893 A * 3/1998 Hill et al. ..... 463/47
5,980,089 A * 11/1999 Weis ..... 700/213
6,039,650 A * 3/2000 Hill ..... 463/47
7,234,698 B2 * 6/2007 Grauzer et al. ..... 273/149 R
7,525,937 B2 * 4/2009 O'Neill ..... 370/328
7,600,671 B2 * 10/2009 Forrest et al. ..... 235/376

* cited by examiner

*Primary Examiner* — Alvin A Hunter
*Assistant Examiner* — Dolores Collins
(74) *Attorney, Agent, or Firm* — Rosenberg, Klein & Lee

(57) ABSTRACT

An automatic playing card dispensing system includes a scanner for recognizing the card suits and card values of the dispensed playing cards, a display, a set of indicator lights, and a driver unit for controlling dispensing of the playing cards and driving the display to display the card suits and card values of the dispensed playing cards been scanned by the scanner and the indicator lights to give a respective indication that indicates "Banker Win", "Player Win" or "Tie Win".

2 Claims, 1 Drawing Sheet

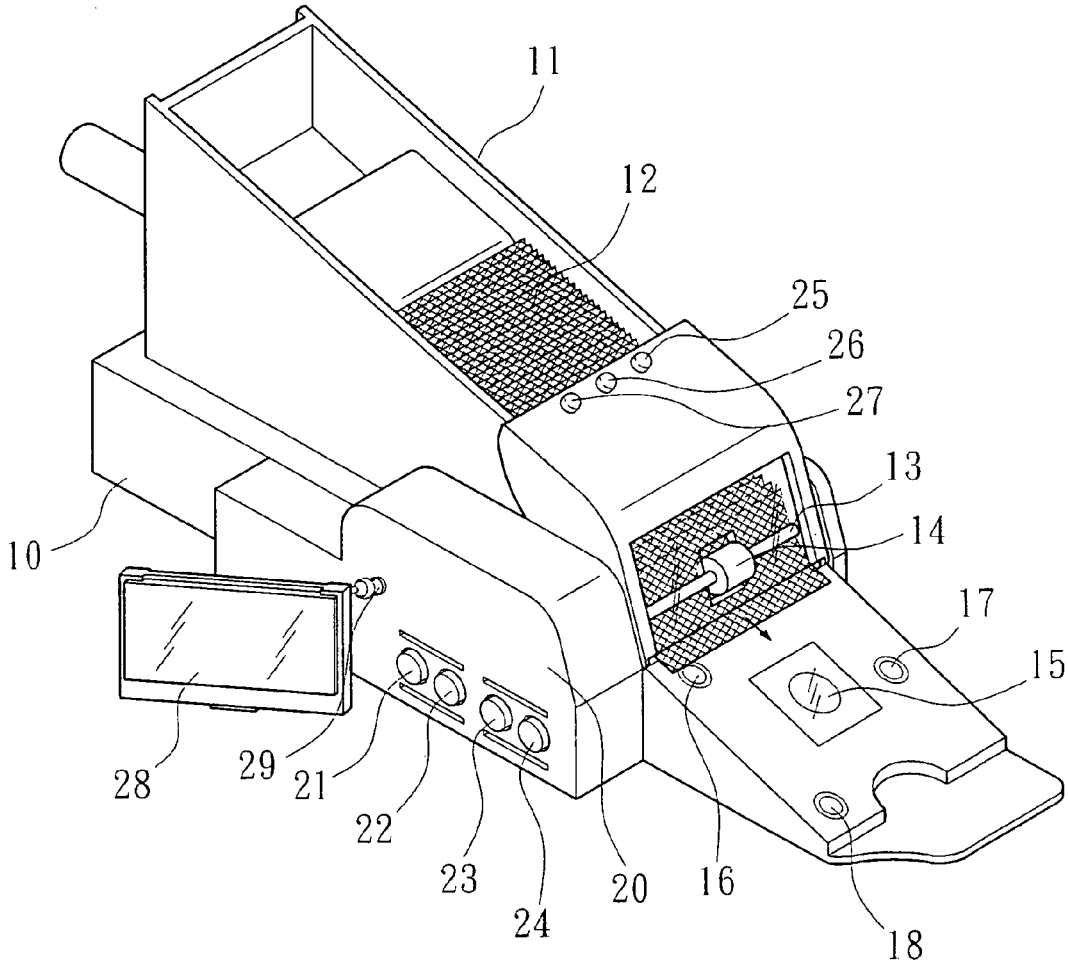
11
12
25
26
27
13
14
10
17
15
28
29
21
22
23
24
20
16
18

AUTOMATIC PLAYING CARD DISPENSING SYSTEM

BACKGROUND OF THE INVENTION

1. Field of the Invention

The present invention relates to playing card dispensers and more particularly, to an automatic playing card dispensing system, which dispenses playing cards and reads the card suits and card values automatically.

2. Description of the Related Art

A regular playing card dispenser generally comprises a shoe having a chute for holding a deck of playing cards, and a motor drive controllable to rotate a card-dispensing roller in dispensing playing cards out of the chute. This design of playing card dispenser simply dispenses playing cards. The dealer needs to deal the dispensed playing cards, to read the card suits and card values of the dealt playing cards, and to judge who the winner is. This design of playing card dispenser has drawbacks as follows:

1. Direct contact of the dealer with the playing cards cannot eliminate human cheating.

2. Human calculation of the card values and game result adjustment cannot eliminate human error.

SUMMARY OF THE INVENTION

The present invention has been accomplished under the circumstances in view. It is one object of the present invention to provide automatic playing card dispensing system, which automatically dispenses playing cards, recognize card suits and card values of dispensed playing cards, avoiding direct contact of the playing cards by the dealer and preventing cheating.

To achieve this and other objects of the present invention, an automatic playing card dispensing system comprises a scanner for recognizing the card suits and card values of the dispensed playing cards, a display, a set of indicator lights, and a driver unit for controlling dispensing of the playing cards and driving the display to display the card suits and card values of the dispensed playing cards been scanned by the scanner and the indicator lights to give a respective indication that indicates "Banker Win", "Player Win" or "Tie Win".

BRIEF DESCRIPTION OF THE DRAWINGS

The FIGURE is an elevational view of an automatic playing card dispensing system according to the present invention.

DETAILED DESCRIPTION OF THE PREFERRED EMBODIMENT

An automatic playing card dispensing system in accordance with the present invention as shown in the FIGURE, comprises a housing 10 having a chute 11 for holding a deck of playing cards 12, a scanner 15 and infrared sensors 16~18 arranged in front of the sloping output port of the chute 11, a driver unit 20 provided at one lateral side of the housing 10, a display 28 provided at one lateral side of the housing 10 at a suitable location. When started the driver unit 20, playing cards 12 are delivered out of the chute 11 in proper order. When one playing card 12 is moved over the scanner 15, the scanner 15 recognizes the card suit and card value of the playing card 12, and gives a signal to the display 28 for displaying the card suit and card value of the playing card 12.

Indicator lights 25~27 are arranged on the top side of the housing 10 above the deck of playing cards 12. The driver unit 20 is controllable to rotate a wheel axle 13 and a rubber dispensing wheel 14 on the wheel axle 13. The wheel axle 13 is transversely pivotally mounted in the sloping output port of the chute 11. The rubber dispensing wheel 14 is rotatable with the wheel axle 13 to dispense the playing cards 12. Operation buttons 21~24 are mounted on the casing of the driver unit 20 for "Start", "Card Value Correction", "Card Suit Correction" and "Enter" function controls respectively. The indicator lights 25~27 are respectively electrically connected to the driver unit 20 for the indication of "Banker Win", "Player Win" or "Tie Win". Further, a universal joint 29 is used for the connection between the display 28 and the casing of the driver unit 20 so that the angular position of the display 28 is conveniently adjustable.

When the dealer pressed the "Start" operation button 21, the drive unit 20 is controlled to rotate the wheel axle 13, causing the rubber dispensing wheel 14 to dispense the playing cards 12. When one playing card 12 is delivered out of the chute 11, it is moved over the scanner 15. The scanner 15 recognizes the card suit and card value of the playing card 12 and gives a signal to the display 28, driving the display 28 to display the card suit and card value of the duly dispensed playing card 12. If an error display of card suit or card value occurred, the dealer can press the "Card Value Correction" operation button 22 or "Card Suit Correction" operation button 23 to correct the display. When corrected, the dealer can press the "Enter" operation button 24 to store the data into the memory means in the driver unit 20. After dispensing of playing cards 12, the driver unit 20 automatically makes a calculation to determine the result that the banker wins, the player wins or breaks even. When the banker wins, the "Banker Win" indicator light 25 is driven to gives off light. When the player wins, the, "Player Win" indicator light 26 is driven to give off light. When breaks even, "Tie Win" indicator light 27 is driven to give off light. Further, the infrared sensors 16~18 are adapted to detect dispensing of playing cards 12. When no any playing card passes or a displaying playing card 12 is deviated from the dispensing course, the infrared sensors 16~18 give a signal, informing the dealer to make correct.

In conclusion, the invention provides an automatic playing card dispensing system, which has the following advantages:

1. Because the system automatically dispenses playing cards, recognize card suits and card values of dispensed playing cards, the dealer does not touch the playing cards directly, avoiding cheating.

2. The system displays the playing card dispensing result through the display 28 so that the dealer can know the situation.

3. The indicator lights 25~27 work subject to the control of the driver unit 20 to indicate game result.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An automatic playing card dispensing system comprising:

a housing having a chute for holding a deck of playing cards, said chute having a sloping output port at a front side thereof, a scanner arranged in front of the sloping output port of said chute for recognizing the card suits and card values of the playing cards that are delivered out of said chute;

a wheel axle transversely pivotally mounted in said sloping output port of said chute;

a rubber dispensing wheel fixedly mounted on said wheel axle and rotatable with said wheel axle to dispense playing cards out of said sloping output port of said chute;

a display means; and a driver unit provided at one lateral side of said housing and electrically connected with said display means and controllable to rotate said wheel axle and adapted for receiving signal from said scanner means and calculating the data received from said scanner means and outputting a control signal to said display means to display the card suits and card values.

2. The automatic playing card dispensing system as claimed in claim 1, further comprising a plurality of infrared sensors mounted in said housing around said scanner and adapted to detect movement of playing cards.

* * * * *